US005106257A

United States Patent [19]

Braud et al.

[11] Patent Number: 5,106,257

[45] Date of Patent: Apr. 21, 1992

[54] LIFT TRUCK WITH TELESCOPIC ARM

[75] Inventors: Marcel Braud, St Laurent des Autels; Michel Dropsy, Bruges, both of France

[73] Assignee: Manitou BF, Ancenis, France

[21] Appl. No.: 645,024

[22] Filed: Jan. 24, 1991

[30] Foreign Application Priority Data

Jan. 24, 1990 [BE] Belgium ..... 9000083

[51] Int. Cl.[5] ..... B66F 9/06

[52] U.S. Cl. ..... 414/718; 414/700; 212/188

[58] Field of Search ..... 414/680, 685, 686, 700, 414/718, 728; 212/187, 188, 182

[56] References Cited

U.S. PATENT DOCUMENTS

| | | | |
|---|---|---|---|
| 2,980,271 | 4/1961 | Ulinski | 414/685 X |
| 3,001,654 | 9/1961 | Albert | 414/685 X |
| 4,147,263 | 4/1979 | Frederick . | |
| 4,280,589 | 7/1981 | Merrick . | |
| 4,318,664 | 3/1982 | Gibert | 414/685 X |

FOREIGN PATENT DOCUMENTS

| | | | |
|---|---|---|---|
| 308595 | 3/1989 | European Pat. Off. . | |
| 1182493 | 6/1959 | France . | |
| 1308396 | 9/1962 | France . | |
| 1527413 | 4/1968 | France . | |
| 2085928 | 12/1971 | France . | |
| 2236776 | 2/1975 | France . | |
| 2287413 | 5/1976 | France . | |
| 243266 | 2/1987 | German Democratic Rep. | 414/685 |

*Primary Examiner*—Robert J. Spar
*Assistant Examiner*—Donald W. Underwood
*Attorney, Agent, or Firm*—Darby & Darby

[57] ABSTRACT

The invention concerns a lift truck with telescopic hoisting arm (2) mounted on a chassis carrying a front axle and a rear axle, in which the telescopic arm is articulated on the truck by means of a variable quadrilateral (A, B, C, D) having a tie rod (23) and an auxiliary arm (24), characterized in that:

the tie rod (23) is articulated on the one hand to the chassis (1) at a point (D) situated substantially above the front axle (10) and on the other hand to the telescopic arm (2) at a point (A) which, in low position of the arm, is substantially above the rear axle (11), the auxiliary arm (24) is articulated on the one hand to the chassis (1) of the truck substantially at the geometric center (C) of the chassis and on the other hand to the telescopic arm (2) at a point (B) situated in back of point (A), and in that, in low position, the telescopic arm (2) is entirely situated below points (A) and (B) of the quadrilateral and rests on the auxiliary arm (24) in a practially horizontal position whereas in high position the auxiliary arm (24) is in a substantially vertical position.

21 Claims, 5 Drawing Sheets

LIFT TRUCK WITH TELESCOPIC ARM

BACKGROUND OF THE INVENTION

The present invention concerns lift trucks with telescopic hoisting arm.

Usually these lift trucks have a chassis carrying a front axle and a rear axle, on which chassis the telescopic arm is mounted.

This hoisting arm is often mounted on a fixed bracket disposed in the rear of the chassis, but it has also been proposed, for example by French Patent No. 1,182,493, to mount the arm on the chassis by means of a variable, i.e., movable, quadrilateral linkage. To this effect, connecting means are provided for connecting two points situated in back of the arm to two points of the chassis.

In the form of realization of that patent, such an arrangement permits assuring a vertical rise of the load, but it can be noted that the truck according to that patent does not permit lifting the loads to great heights and that moreover the hoisting arm hinders the operator's vision practically along its entire displacement.

The main disadvantage of the known lift trucks resides in the loss of handling capacity both horizontally and vertically as the telescopic hoisting arm rises.

To illustrate this fact, FIG. 1 shows schematically the diagram of the hoisting capacities of a known lift truck, here a truck whose arm is articulated on a fixed bracket above the rear axle. The superimposed elements at the upper right of FIGS. 1 and 6 represent the fork at the end of the hoisting arm which carries a load normalized at a volume of one cubic meter, i.e. 1000 millimeters on each side. The center of gravity of the load is 500 millimeters from the faces of the fork in both height and width. On the graph the horizontal axis H is the distance between the center of gravity of the load and the front side of the front wheels of the truck and the vertical axis V is the distance between the center of gravity of the load and the ground on which the trunk wheels ride, the ground assumed to be horizontal. The curves within the graph is the weight of the maximum load of the normalized dimensions which can be supported by the lift truck without any rocking.

It is seen that heavy loads, that is of between 2500 and 3000 kg, carried on a deck which not only is small but is situated more than four meters from the ground is unworkable since the truck cannot, without rocking, support the load between the ground and this height.

In order to limit the risks of rocking of the truck, one is obliged to provide the use of stabilizers carried by the chassis of the machine and taking support on the ground. These stabilizers artifically increase the stability of the machine and may lead the operators to take more and more chances in counting on them.

BRIEF DESCRIPTION OF THE INVENTION

The invention aims to propose a machine of greatly increased stability even without the use of the stabilizers, and which offers the operator very good visibility as well.

To this effect, the present invention proposes a lift truck with telescopic hoisting arm mounted on a chassis carrying a front axle and a rear axle, in which the telescopic arm is articulated on the truck by means of a variable quadrilateral linkage (A, B, C, D) having a tie rod and an auxiliary arm characterized in that:

The tie rod is articulated on the one hand to the chassis at a point (D) situated substantially above the front axle and on the other hand to the telescopic arm at a point (A) which, in the low position of the arm, is substantially above the rear axle.

The auxiliary arm is articulated on the one hand to the chassis of the truck substantially in the geometric center (C) of the chassis and on the other hand to the telescopic arm at a point (B) situated behind point (A).

In low position, the telescopic arm is entirely located below points (A) and (B) of the quadrilateral and rests on the auxiliary arm in a practically horizontal position while in high position the auxiliary arm is in a substantially vertical position.

Said quadrilateral is variable under the action of a hoisting jack articulated on the one hand to the chassis at a point thereof situated between the hinge points (D) and (C) of said tie rod and auxiliary arm, and on the other hand to the hoisting arm at a point situated forward of said point (A).

The construction of the variable quadrilateral is symmetrical on either side of the arm, and consequently each hinge device of a telescopic arm will comprise two tie rods, two auxiliary arms and two jacks, situated on either side of the longitudinal median plane of the truck. According to an advantageous variant, the two auxiliary arms might however be replaced by a tube of a cross section substantially equal to that of the telescopic arm and whose rear end connects to two lateral cheek plates carrying the hinge axle of the telescopic arm so as to permit the relative displacement of the telescopic arm and of the auxiliary arm.

By adopting the means according to the invention for articulating the arm of the lift truck to the chassis, one obtains a truck whose load curves have, as can be seen in FIG. 6, more flat shapes reflecting a great increase of the capaities of the machine; in particular it is seen that the heaviest loads, between 2,500 and 3,000 kg, can effectively be lifted off the ground with the fork being closer to the front wheels.

The means according to the invention assure moreover a longitudinal and transversal stability of the machine greatly superior to that of the known machines by advancing the center of gravity of the machine during the raising of the arm.

During this raising of the hoisting arm, the action of the jack adjusts the variable quadrilateral, in such a way that said tie rod and auxiliary arm are rotated relative to their hinge-points on the chassis in the sense tending to raise them vertically.

The particular arrangement of the points of the variable quadrilateral on the chassis and the use of an auxiliary arm and of a tie rod of great length, because the tie rod is articulated to the telescopic arm at a point located in the low position of said arm substantially above the rear axle, permit causing the auxiliary arm to pass from a low position in which it is in practically horizontal position to a high position in which it is substantially vertical.

The rear of the hoisting arm is during this movement elevated by a height substantially equal to that of the auxiliary arm.

Such a movement is not possible in the arrangement of the French patent already mentioned due to the fact that it does not have an auxiliary arm able to pass from a practically horizontal position to a practically vertical position and is greatly advantageous because it permits making use of a hoisting arm having fewer telescopic elements to attain a fixed maximum height identical with a machine of known type.

With a construction according to the invention, a truck is obtained which can effectively lift heavy loads, as represented in the diagram of FIG. 6, and which, owing to the combined displacement of the hinge point toward the geometric center and upward, is of an improved stability and requires fewer telescoping elements to attain the maximum height.

The reduced number of telescoping elements has the advantage of permitting weight reduction of the machine, which added to the notable increase in the stability during use, allows the adoption of a much lighter counterweight on the rear axle which is therefore easier to manufacture and less expensive.

The reduction of weight of the machine resulting from the lesser number of elements of the telescoping structure and lighter counterweight is further improved by the fact that it allows the adoption of a less powerful and hence less heavy drive train.

By articulating the hoisting arm according to the device of the present invention, there is no need to use a bracket, normally solid, which used to greatly obstruct the rearward vision of the operator. As the hoisting arm rests on the auxiliary arm in a practically horizontal position in the low position, the operator has full vision in this position, which is the one in which he normally carries out the displacements of the machine.

Another advantage procured by the arrangement according to the invention resides in the fact that in the low position it is possible to use the machine as a pusher.

The lift truck according to the invention is further characterized in that:

the tie rod is a dual element formed by two similar tie rods disposed symmetrically relative to the longitudinal median plane of the lift truck, the tie rod is arched, so that, in the low position of the hoisting arm, the central portion thereof extends in the overall dimension of said arm and does not obstruct the operator's field of vision, the auxiliary arm is in one piece ending in two cheek plates passing on either side of the rear end of the hoisting arm, the hoisting jack is a dual element formed by two jacks arranged symmetrically relative to the longitudinal median plane of the truck, an auxiliary jack is disposed under the auxiliary arm and articulated on said auxiliary arm at a point (H) and on the chassis at a point (G) situated between the hinge point (C) of said auxiliary arm and the rear axle, said auxiliary arm is crozier-shaped, the chassis is formed by two elements having the overall form of an L whose small side is of a length substantially equal to the height (d) between the axis of the front axle and the lower hinge point (D) of the tie rod.

Although applicable to any truck with telescopic arm, the present invention is intended more particularly for lift trucks of whose bulky members (drive group, transmission, cabin) are arranged so as to completely clear a platform around the longitudinal median axis to accommodate the telescopic hoisting arm and its means of articulation.

BRIEF DESCRIPTION OF THE DRAWINGS

Other characteristics and advantages of the invention will become evident from the following description of a preferred non-limiting example of realization in connection with the annexed drawings in which.

DETAILED DESCRIPTION OF THE INVENTION

Figure 2:
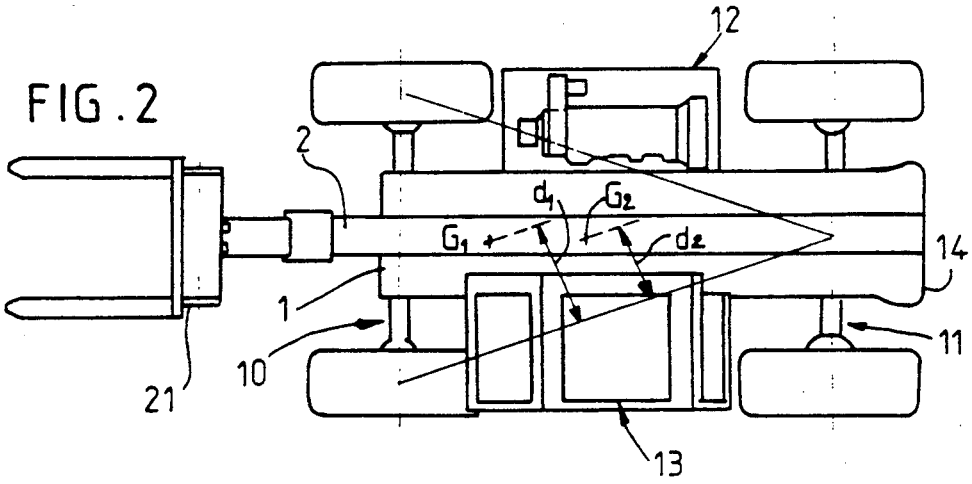
FIG. 2 is a schematic view from above of a lift truck according to the invention.

FIG. 2 shows schematically the arrangement of the various elements of the lift truck on the chassis 1 which carries a front axle 10 and a rear axle 11. According to a known implementation, the drive group 12, intended for the propulsion of the machine in its displacements and for the supply of the hydraulic power required in the hoisting operations of the arm, is disposed on one side of the chassis, here the right side, between the front and rear wheels. On the side of the chassis opposite the one where said drive group 12 is placed, is the cabin 13 from which such a machine is driven. It is seen that a large platform is then available along the longitudinal median axis in order to accommodate the hoisting arm 2 and the means permitting to assure its lifts and descents, not shown in FIG. 2.

The hoisting arm 2 is telescopic and made up of two or three elements; the end of the inner element carries a hook-up plate for tools such as forks (as shown), scoops, concrete buckets, etc.

Figure 3:
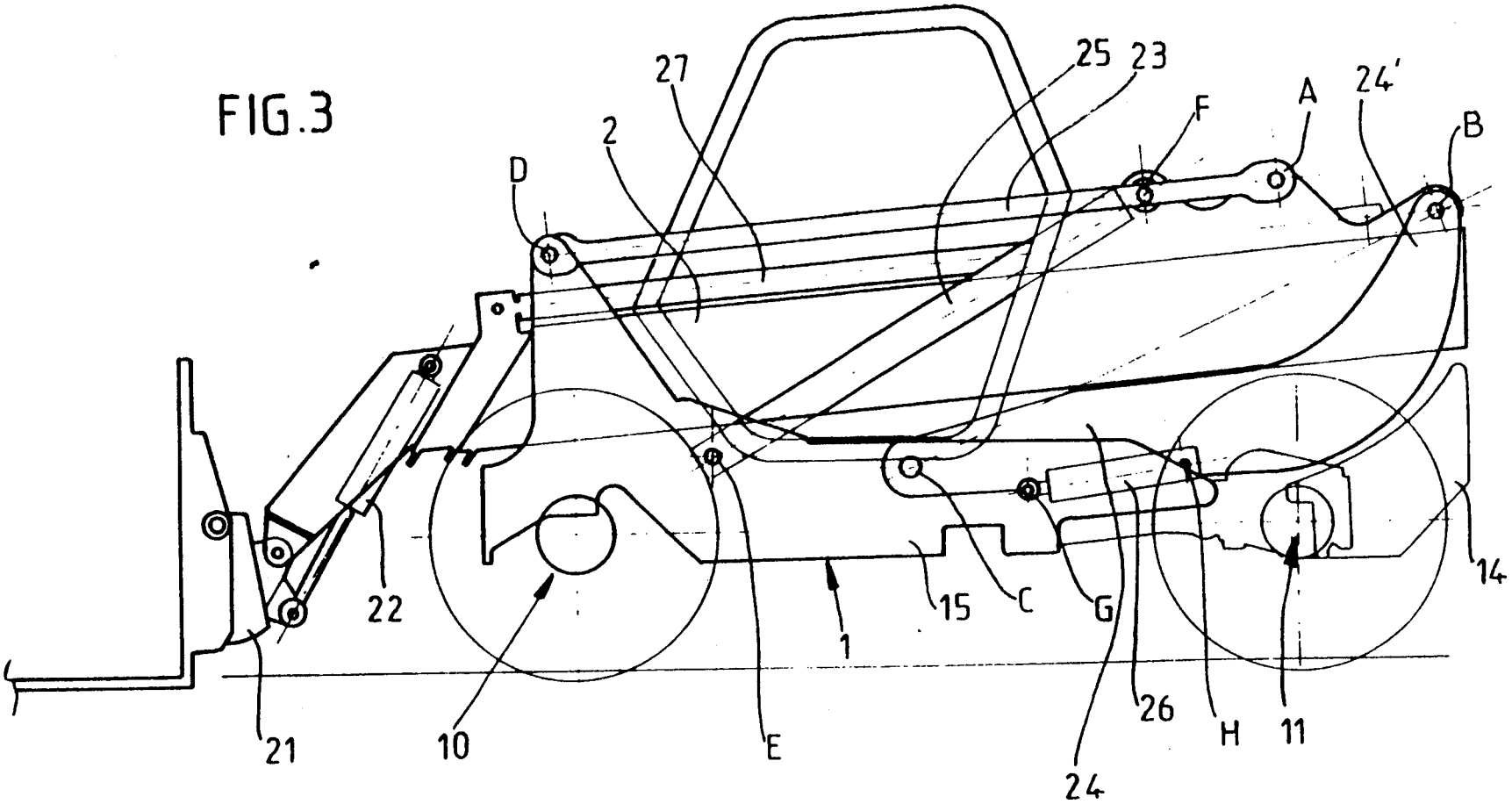
FIG. 3 is a side view of a lift truck making use of the invention, with the arm in low position.
Figure 4:
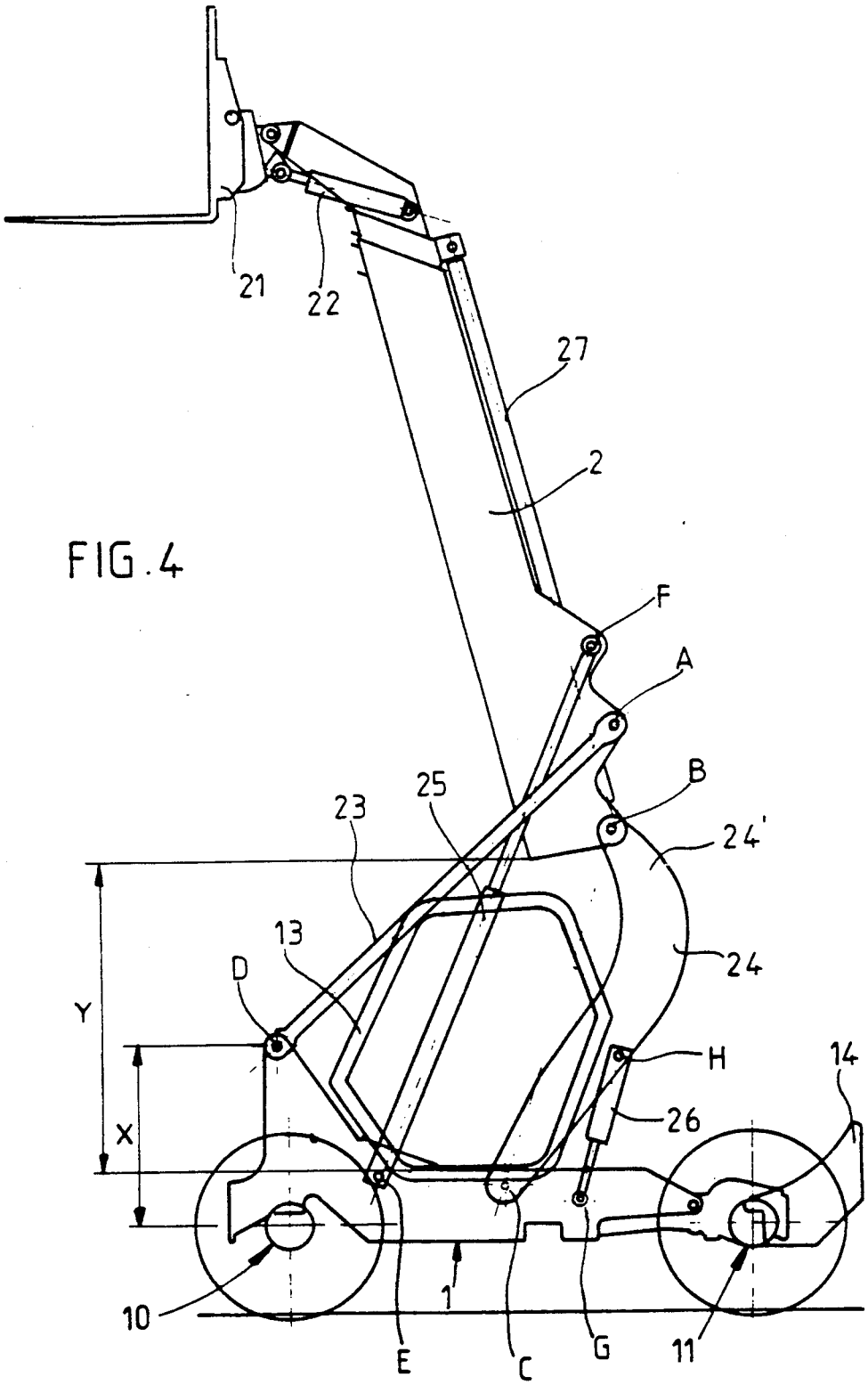
FIG. 4 is a view similar to FIG. 3 with the arm in raised position.

As can be seen in FIGS. 3 and 4, and known per se, a so-called compensation jack 22 assures the holding of the tool horizontal all along the movements of the hoisting arm 2.

The chassis 1 also carries at its rear end a counterweight 14 intended to increase the longitudinal stability of the machine.

FIGS. 3 and 4 represent the articulation according to the invention of the hoisting arm 2 on the chassis 1 of the machine.

It is noted that arm 2 is connected to chassis 1 by means of a variable quadrilateral ABCD having a tie rod 23 and an auxiliary arm 24.

The tie rod 23 is articulated, on the one hand, at a point A situated on arm 2 substantially above the rear axle 11 in the low position of the arm shown in FIG. 3, and on the other hand, at its other end, at D on chassis 1. Point D is chosen in a horizontal plane extending at some distance "x" above the front axle 10, and substantially above said front axle 10.

At a point B situated behind point A and for example, as represented, at the rear end of arm 2 is articulated the auxiliary arm 24 whose other end is articulated at C on chassis 1. Point C is situated, as can be seen in the figures, in a plane parallel to the axles 10, 11 and containing the geometric center of chassis 1.

The hinge points A and B of the tie rod 23 and of the auxiliary arm 24 are provided on the top of arm 2 so that in the low position of FIG. 3 the latter is entirely under these points A, B. In this low position, the hoist arm 2 rests on the auxiliary arm 24 in a practically horizontal position.

In this position, the tools carried by the hook-up plate 21 rest on the ground. Advantageously, the forces applied on said plate are practically horizontal so that, by hook-up of a suitable tool, it can be provided to use the truck as a pusher, which may be useful on construction yards.

Preferably, the auxiliary arm 24 is situated around the longitudinal median plane of the lift truck. Said arm 24 is of one piece and ends in two cheek plates 24' passing on either side of the rear end of arm 2 to be articulated on the arm at B by any known means. In the example represented, the auxiliary arm 24 is then provided in the form of a crozier and point C is positioned in the geometric center of the chassis.

Two similar tie rods 23 are arranged symmetrically relative to the longitudinal median plane of the chassis between pairs of points D on the chassis and A on the hoisting arm 2.

The hoisting arm 2 is thus articulated to chassis 1 by a variable quadrilateral ABCD of which AB is a portion of itself and CD a part of chassis 1.

To raise and lower said arm 2, said quadrilateral ABCD is varied by the action of a hoisting jack 25 which according to the invention is articulated at one of its ends on chassis 1 at a point E situated between C and D and at the other end on the hoisting arm 2 at a point F situated ahead of point A.

The hoisting jack 25, too, is a dual element formed by two jacks disposed symmetrically relative to the longitudinal median plane of the truck.

The action of jack 25 is assisted in the represented implementation of the invention by an auxiliary jack 26 disposed under the auxiliary arm 24 and articulated on said auxiliary arm 24 at H and on chassis 1 at a point G situated between the hinge point C of the auxiliary arm 24 and the rear axle 11.

The overall dimension of cabin 13 is represented in the figures to show that the arrangement according to the invention permits to largely clear the operator's field of vision, laterally and rearward.

It is seen in FIG. 3 that the fact of providing that in low position the hoisting arm rests on the auxiliary arm practically horizontally permits not to obstruct the operator's view during displacements of the truck. The practically horizontal low position of the hoisting arm 2 is made possible by the particular arrangement of the points of the variable quadrilateral and by the lengths of the tie rod 23 and of the auxiliary arm 24 causing said quadrilateral to be arranged in the aggregate on the full wheel-base of the truck.

In FIG. 4 showing the truck with the hoisting arm 2 raised, it is seen that the rear end thereof is now elevated relative to the chassis by a height Y substantially equal to the length of the second arm 24. Such an arrangement permits using a telescopic arm having fewer elements and hence is much less heavy than that normally used for a given hoisting height.

In FIG. 3 it can also be seen that in the position of rest in which arm 2 is placed entirely on the chassis, the auxiliary arm 24 bears on the counterweight 14, whose form is then provided to that effect. As the telescopic arm is less heavy and the arrangement according to the invention assures a good stability of the truck, the counterweight 14 can then be less heavy and it will be easier to manufacture, permitting it to be given a well designed form. Tests have shown that the counterweight may be reduced by 25 to 30% relative to that of equivalent machines.

The chassis 1 of the truck according to the invention can also be made lighter and, in a manner of great interest because easy to manufacture, provided in the form of two elements 15 having the overall form of an L whose small side is of a length substantially equal to "x" while, as can be seen in the figures, the major side is of a dimension less than the wheel-base of the machine. The rear axle is then articulated to the chassis.

Figure 5:
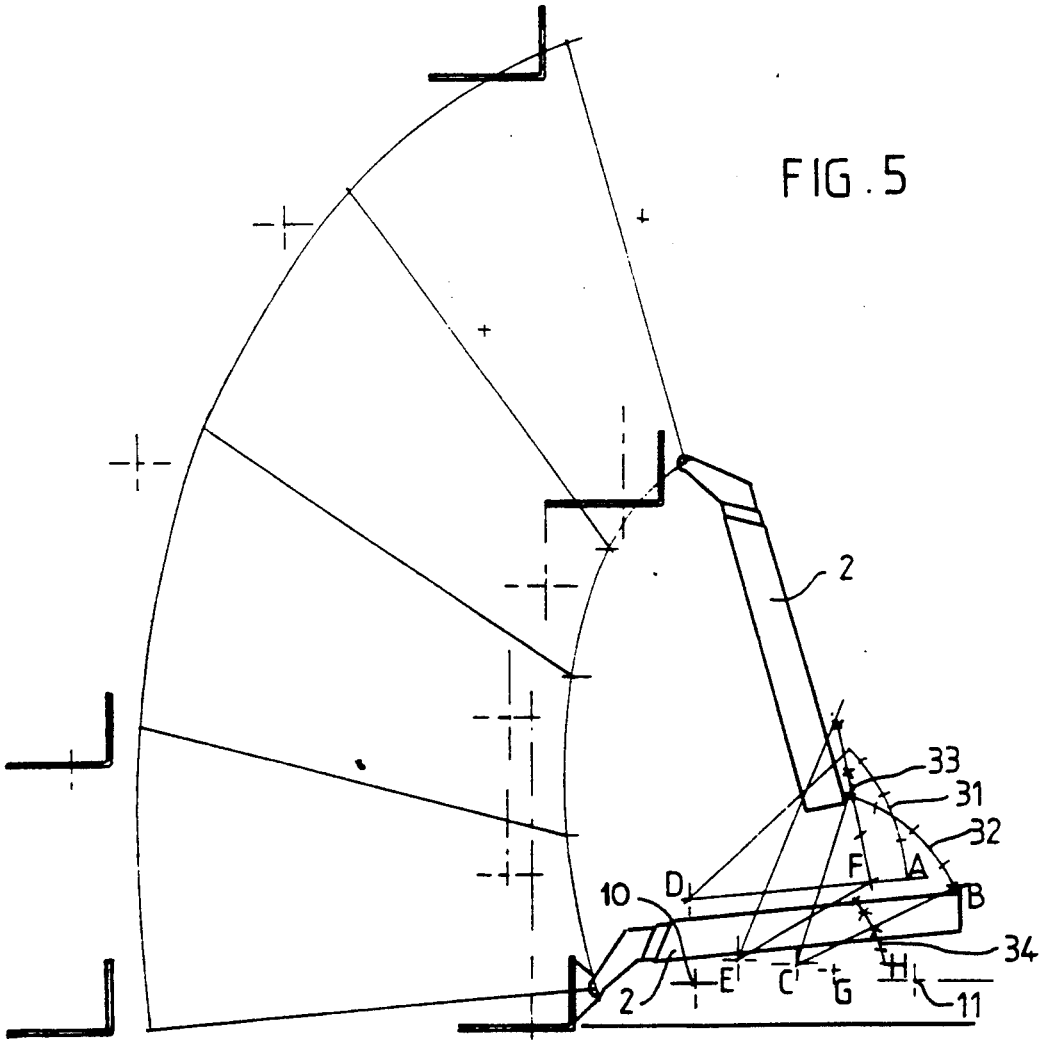
FIG. 5 shows schematically the displacements of different hinge points when the arm is being raised.

FIG. 5 shows the displacements of points A, B, F and H in the course of the movements of arm 2 between its position of rest and its position raised to the maximum. The curves representing the respective positions of said points A, B, F and H have been denoted 31, 32, 33, 34.

Figure 1:
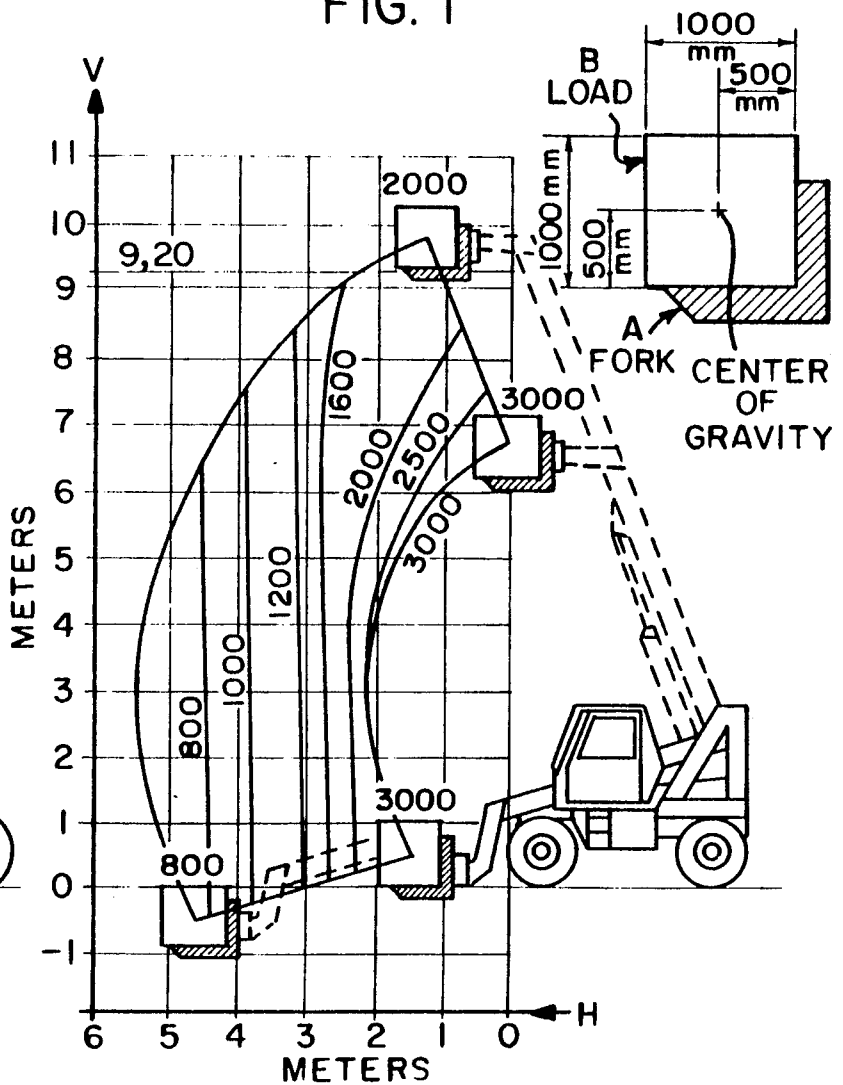
FIG. 1 is a diagram of the load curves for a truck of known type.
Figure 6:
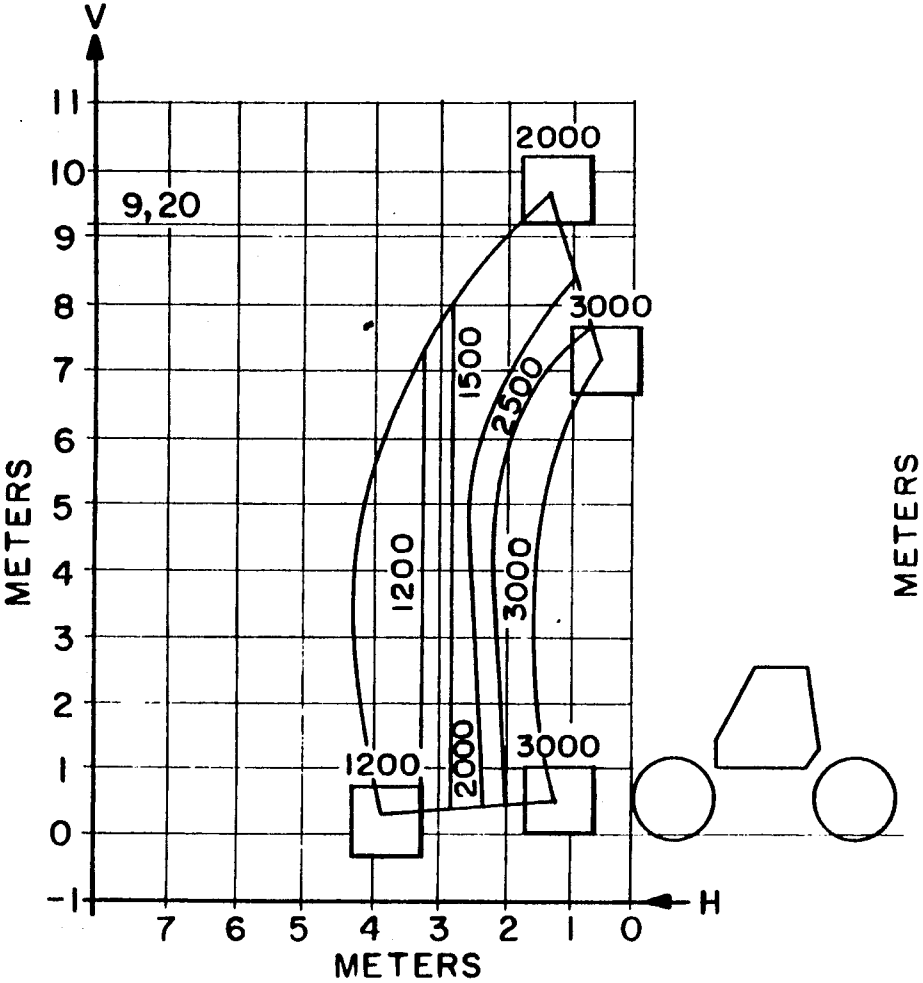
FIG. 6 is a diagram similar to that of FIG. 1 for a truck making use of the invention.

Referring to FIGS. 1 and 6, it is noted that the contours of the graphs of the load diagram of the machine according to the invention are much flatter than those of the conventional trucks. This reflects a considerable increase of the capatities of the machine.

It is known that the stability of a truck at end of lifting stroke of its hoisting arm depends on its transverse stability.

To measure this transverse stability, the method to be followed, given by the national guidelines, consists in placing the truck on a tipping platform.

The truck is positioned so that one of the sides of the supporting polygon other than the front axle is parallel to the tipping axis of the platform. It is then found that the maximum permissible inclination of the platform is $(d/H)\times 100$, where d is the distance of the center of gravity on the side of the supporting polygon parallel to the tipping axis of the platform, and H is the height of the center of gravity relative to the ground.

The truck according to the invention has, when the arm is raised and deployed, its center of gravity at the same height H as the conventional truck.

FIG. 2 shows the supporting polygon of the truck which, for the lift trucks such as those to which the invention relates, is, in a manner known in itself, a triangle whose base is the front axle 10 and the apex the axis about which the rear axle rotates. The respective centers of gravity of a truck according to the invention and of a conventional truck in the high position of the hoisting arm are marked G1 and G2.

As can be seen in this FIG. 2, G1 is much closer to the front of the truck than G2. The distance d1 is then greater than d2, which indicates a greater transverse stability of the truck according to the invention as compared with the conventional truck.

In addition to its better hoisting capacities owing to its stability, the truck according to the invention can be of reduced overall dimension and the beams of the hoisting arm will also be shorter.

Figure 7:
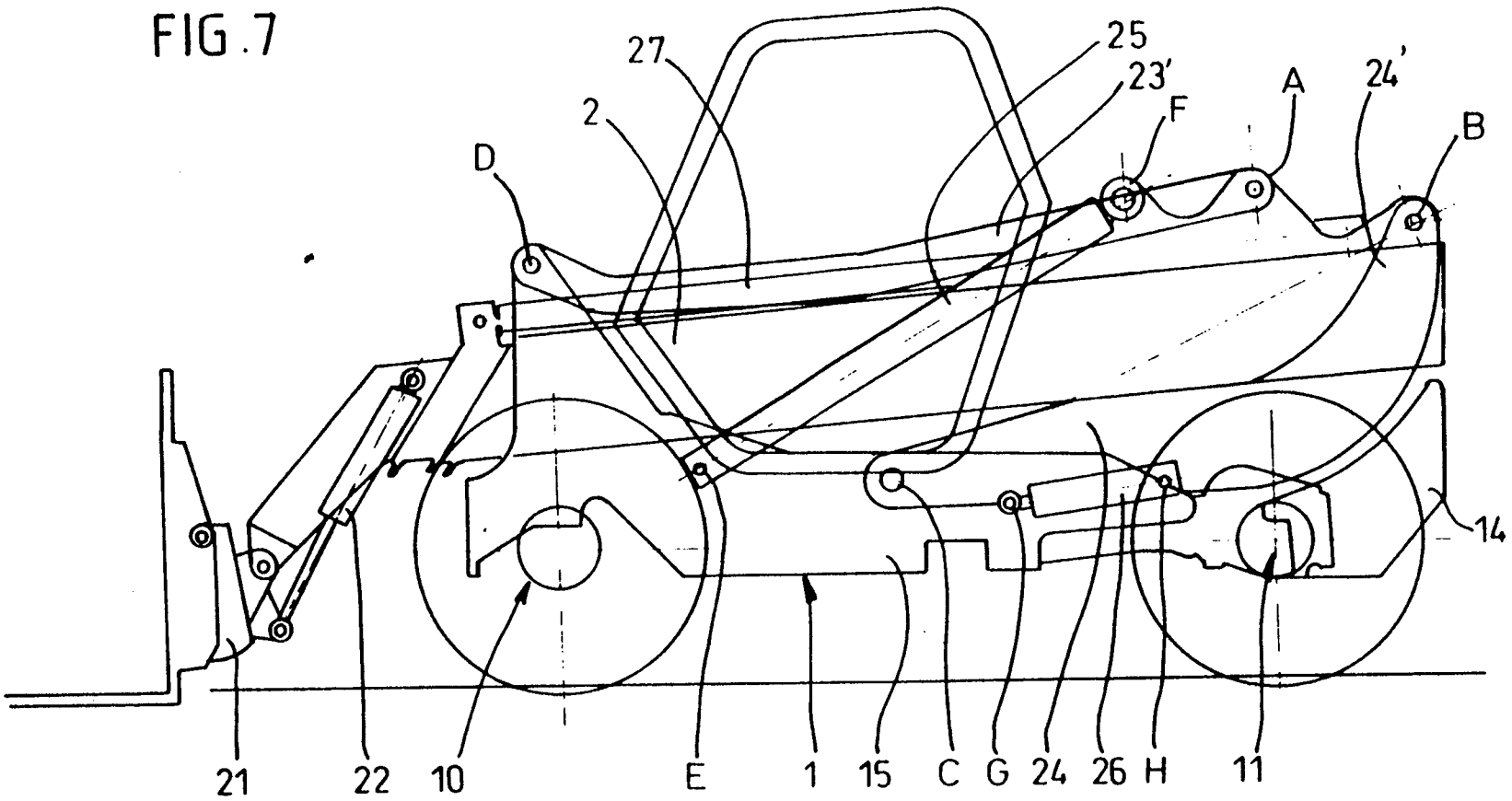
FIG. 7 is a view similar to that of FIG. 3 for a variant embodiment of the tie rod.

Referring to FIG. 7, it is noted that the tie rod 23 can be given a different form in order to clear the operator's view still more completely. In this figure, the tie rod 23' is of arched form. Owing to this, the central part thereof, which extends along the cabin 13 when the arm is in low position, is disposed in the overall dimension of said arm and constitutes no additional hindrance for the operator.

We claim:

1. A lift truck comprising a telescopic hoisting arm mounted on a chassis carrying a front axle and a rear axle, in which the telescopic arm is articulated on the truck for movement between a low position and a high position by means forming a linkage of variable quadrilateral form including a tie rod and an auxiliary arm, the tie rod is articulated at one end to the chassis at a lower hinge point situated substantially above the front axle and at the other end to the telescopic arm at a first point which, in the low position of the arm, is substantially above the rear axle, the auxiliary arm is articulated at one end to the chassis substantially at its geometric center and at the other end to the telescopic arm at a second point in back of the first point, in the low position, the telescopic arm is entirely situated below the first and second points of the quadrilateral and rests on the auxiliary arm in a substantially horizontal position while in the high position the auxiliary arm is in a substantially vertically position.

2. A lift truck according to claim 1 wherein said linkage means is variable under the action of a hoisting jack articulated to the chassis at a third point located between the hinge points of said tie rod and auxiliary arm and at the other end to the hoisting arm at a fourth point in front of said first point.

3. A lift truck according to claim 1 wherein the tie rod is a dual element formed by two similar tie rods disposed symmetrically relative to the longitudinal median plane of the lift-truck.

4. A lift truck according to claim 1 wherein the tie rod is of arched form, so that, in the low position of the hoisting arm, the central part thereof extends in the overall direction of said arm and does not obstruct the operator's field of vision.

5. A lift truck according to claim 1 wherein the auxiliary arm is in one piece ending in two cheek plates passing on either side of the rear end of the hoisting arm.

6. A lift truck according to claim 2 wherein the hoisting jack is a dual element formed by two jacks disposed symmetrically relative to the longitudinal median plane of the truck.

7. A lift truck according to claim 1 wherein an auxiliary jack is disposed under the auxiliary arm and articulated on said auxiliary arm at a point between its ends and on the chassis at a point situated between the hinge point of said auxiliary arm and the rear axle.

8. A lift truck according to claim 1 wherein said auxiliary arm is crozier-shaped.

9. A lift truck according to claim 1 wherein the chassis is formed by two elements having in the aggregate the form of an L whose small side is of a length substantially equal to the height (d) between the axis of the front axle and the lower hinge point of the tie rod.

10. A lift truck according to claim 2 wherein the tie rod is a dual element formed by two similar tie rods disposed symmetrically relative to the longitudinal median plane of the lift-truck.

11. A lift truck according to claim 2 wherein the tie rod is of arched form, so that, in the low position of the hoisting arm, the central part thereof extends in the overall direction of said arm and does not obstruct the operator's field of vision.

12. A lift truck according to claim 2 wherein the auxiliary arm is in one piece ending in two cheek plates passing on either side of the rear end of the hoisting arm.

13. A lift truck according to claim 5 wherein a dual element hoisting jack formed by two jacks disposed symmetrically relative to the longitudinal median plane of the truck is connected between the hoisting arm and chassis.

14. A lift truck according to claim 2 wherein an auxiliary jack is disposed under the auxiliary arm and articulated on said auxiliary arm at a fifth point and on the chassis at a sixth point situated between the hinge point of said auxiliary arm and the rear axle.

15. A lift truck according to claim 5 wherein an auxiliary jack is disposed under the auxiliary arm and articulated on said auxiliary arm at a point between its ends and on the chassis at a point situated between the hinge point of said auxiliary arm and the rear axle.

16. A lift truck according to claim 2 wherein said auxiliary arm is crozier-shaped.

17. A lift truck according to claim 5 wherein said auxiliary arm is crozier-shaped.

18. A lift truck according to claim 2 wherein the chassis is formed by two elements having in the aggregate the form of an L whose small side is of a length substantailly equal to the height (d) between the axis of the front axle and the lower hinge point of the tie rod.

19. A lift truck according to claim 3 wherein the chassis is formed by two elements having in the aggregate the form of an L whose small side is of a length substantailly equal to the height (d) between the axis of the front axle and the lower hinge point of the tie rod.

20. A lift truck according to claim 4 wherein the chassis is formed by two elements having in the aggregate the form of an L whose small side is of a length substantailly equal to the height (d) between the axis of the front axle and the lower hinge point of the tie rod.

21. A lift truck according to claim 6 wherein the chassis is formed by two elements having in the aggregate the form of an L whose small side is of a length substantailly equal to the height (d) between the axis of the front axle and the lower hinge point of the tie rod.

* * * * *